US006437267B1

(12) United States Patent
Imai

(10) Patent No.: US 6,437,267 B1
(45) Date of Patent: Aug. 20, 2002

(54) WATER PROOF AND DUST PROOF STRUCTURE OF KEY SWITCH DEVICE

(75) Inventor: Fumihito Imai, Tokyo (JP)

(73) Assignee: NEC Corp. (JP)

( * ) Notice: Subject to any disclaimer, the term of this patent is extended or adjusted under 35 U.S.C. 154(b) by 0 days.

(21) Appl. No.: 09/640,309

(22) Filed: Aug. 16, 2000

(30) Foreign Application Priority Data

Aug. 20, 1999 (JP) ..... 11-233766

(51) Int. Cl.[7] ..... H01H 9/04
(52) U.S. Cl. ..... 200/302.1; 200/302.2
(58) Field of Search ..... 200/293, 302.2, 200/302.1, 329, 341

(56) References Cited

U.S. PATENT DOCUMENTS 4,980,522 A * 12/1990 Murakami et al. ..... 200/5

FOREIGN PATENT DOCUMENTS

| | | |
|---|---|---|
| DE | 2140623 | * 11/1984 |
| EP | 0210973 | 2/1987 |
| EP | 1001443 | 5/2000 |
| JP | 5-34755 | 5/1993 |
| JP | 6-17056 | 3/1994 |
| JP | 8-180756 | 7/1996 |

* cited by examiner

*Primary Examiner*—P. Austin Bradley
*Assistant Examiner*—Lisa N. Klaus
(74) *Attorney, Agent, or Firm*—Dickstein, Shapiro, Morin & Oshinsky, LLP.

(57) ABSTRACT

It is an object to attain simplification of the device assembly work and lowering of the cost, and to raise the water proof and dust proof effect. The structure includes an instrument case (2) having a key insertion hole (7) open to the inside and outside of the case, a key base (3) contained in this instrument case (2) and having a switch contact point portion, and a key seat (4) which is provided on the switch contact point portion side of this key base (3) and which is made of a flexible member having a key (9) inserted into the key insertion hole (7) and a switch thrust piece (11) corresponding to the switch contact point portion on the seat surface side and on the seat reverse side, respectively, and it is configured such that a frame-like rib (10) which is pressed and brought into contact with the inside opening periphery of the key insertion hole (7) and which surrounds the side portion of the key (9) is provided integrally to this key seat (4).

10 Claims, 7 Drawing Sheets

WATER PROOF AND DUST PROOF STRUCTURE OF KEY SWITCH DEVICE

BACKGROUND OF THE INVENTION

1. Field of the Invention

The present invention relates to a water proof and dust proof structure of a key switch device, which is preferable for use, for example, in mobile communication terminal such as a portable wireless phone or cellular phone.

2. Description of the Prior Art

Recently, accompanied with liberalization of the electric communication business, popularization of various mobile communication terminal including a portable wireless phone or cellular phone has been developed.

Usually, a user puts a mobile communication terminal in a bag or a pocket of clothes and carries it outdoors, and thus, the water proof and dust proof structure has strongly requested for the mobile communication terminal. Particularly, the water proof and dust proof structure is requested for a key switch device of the terminal.

Previously, for the water proof and dust proof structure of a key switch device in this type of a portable wireless phone or cellular phone, a structure has been employed, which includes an instrument case having a key insertion hole open between the inside and outside surfaces of the case and a fitting groove open in the inside opening periphery of this key insertion hole, a key base contained in this instrument case and having a switch contact point portion, a rubber seat provided on the switch contact point portion side of this key base and having a key inserted into the key insertion hole and a switch thrust piece corresponding to the switch contact point portion on the base side, and a spacer provided between this rubber seat and the instrument case and pressing and bringing a seal member into contact with the inside of the fitting groove.

In such a water proof and dust proof structure of a key switch device, the seal member is provided between the instrument case and the spacer in a state of being compressed, and the portable wireless phone or cellular phone is assembled, and the place between the instrument case (seal member) and the spacer and the place between the spacer and the rubber seat are sealed.

However, in this type of water proof and dust proof structure of a key switch device, a seal member and a spacer are provided between the instrument case and the rubber seat, and therefore, there has been such a problem that the number of pieces of parts is increased so that not only the assembly work may become complicated but also the cost may be raised.

Furthermore, in a conventional water proof and dust proof structure of a key switch device, not only a seal member but also a spacer is provided between the instrument case and the rubber seat, and therefore, the pressing and contacting force of the spacer to the seal member becomes insufficient, and in addition, rain water or the like stays in the key insertion hole, so that the water level may be higher than the sealing position between the spacer and the rubber seat at all times, and it has been impossible to maintain the sealing function between the rubber seat and the spacer and the reliability in sealing are reduced. As a result of this, the rain water cannot surely be prevented from reaching electronic parts such as a key base, and there has been a problem of lowering the water proof and dust proof effect.

Herein, Japanese Utility Model Application Laid-Open No. 5-34755 published on May 7, 1993 and Japanese Utility Model Application Laid-Open No. 6-17056 published on Mar. 4, 1994 disclose prior arts as [structure of an operating portion of telephone] and [water proof structure of a keyboard switch], respectively, but the above described problems are not solved.

SUMMARY OF THE INVENTION

It is an object to provide a water proof and dust proof structure of a key switch device, by which simplification of the device assembly work and lowering of the cost can be attained, and in the meantime, the water proof and dust proof effect can be raised.

In order to attain the above described object, a water proof and dust proof structure of a key switch device of the present invention includes: an instrument case having a key insertion hole open to the inside and outside of the case; a key base contained in this instrument case and having a switch contact portion; and a key seat which is provided on the key base and which is made of a flexible member having a key inserted into the key insertion hole and a switch thrust piece corresponding to the switch contact portion on the seat surface side and on the seat reverse side, respectively, and it is configured such that a frame-like rib which is pressed and brought into contact with the inside opening periphery of the key insertion hole and which surrounds the side portion of the key is provided integrally to this key seat.

Accordingly, the sealing is performed between the opening end surface of the rib in the key seat and the opening periphery of the key insertion hole in the instrument case.

The water proof and dust proof structure of a key switch device of the present invention may also be configured such that a frame-like rising wall which is positioned inside the rib and which is pressed and brought into contact with the seat surface of the key seat is integrally provided to the inside opening periphery of the key insertion hole.

According to this configuration, in the sealed state, the opening end surface of the rib is pressed and brought into contact with the opening periphery of the key insertion hole, and in the meantime, the opening end surface of the rising wall is pressed and brought into contact with the seat surface side of the key seat.

Furthermore, the water proof and dust proof structure of a key switch device of the present invention may also be configured such that a projection whose wall thickness becomes smaller toward the key seat side from the key insertion hole side is formed at the tip surface of the rising wall.

According to this configuration, in the sealed state, the projection of the rising wall is pressed and brought into contact with the seat surface of the key seat so that it may bite into the seat surface.

Another water proof and dust proof structure of a key switch device according to the present invention includes: an instrument case having a key insertion hole open to the inside and outside of the case; a key base contained in this instrument case and having a switch contact point portion; and a key seat which is provided on the switch contact point portion side of this key base and which is made of a flexible member having a key inserted into the key insertion hole and a switch thrust piece corresponding to the switch contact point portion on the seat surface side and on the seat reverse side, respectively, and it is configured such that a rib and a rising wall surrounding the side portion of the key are integrally provided at the seat surface of this key seat and at the inside opening periphery of the key insertion hole, respectively, and that seal portions which are pressed and brought into contact with each other are provided at the respective tip portions of these rising wall and rib.

Accordingly, in the sealed state, the seal portion of the rib and the seal portion of the rising wall are pressed and brought into contact with each other.

The water proof and dust proof structure of a key switch device of the present invention may also be configured such that each seal portion of the rib and the rising wall is formed by a slant surface.

According to this configuration, in the sealed state, the slant surface of the rib and the slant surface of the rising wall are pressed and brought into contact with each other.

The water proof and dust proof structure of a key switch device of the present invention may also be configured such that one seal portion among the seal portion of the rib and the seal portion of the rising wall is formed by a projection having an approximately half-circular cross section, and that the other seal portion is formed by a projection having an approximately triangular cross section.

According to this configuration, in the sealed state, the respective projections in the rib of the key seat and the rising wall of the instrument case are pressed and brought into contact with each other.

BRIEF DESCRIPTION OF THE DRAWINGS

This above-mentioned and other objects, features and advantages of this invention will become more apparent by reference to the following detailed description of the invention taken in conjunction with the accompanying drawings, wherein.

DETAILED DESCRIPTION OF THE PREFERRED EMBODIMENTS

Figure 1:
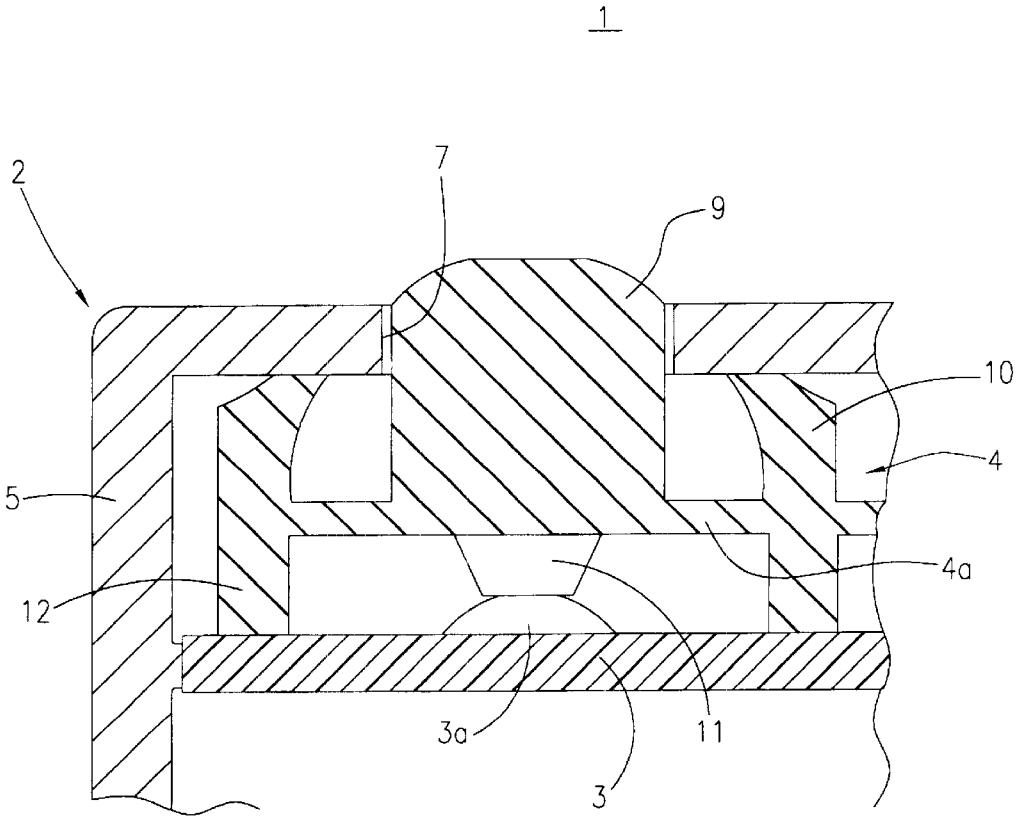
FIG. 1 is a cross sectional view showing a water proof and dust proof structure of a key switch device according to a first embodiment of the present invention.

The preferred embodiments of the present invention will be described below by referring to the drawings.

Figure 2:
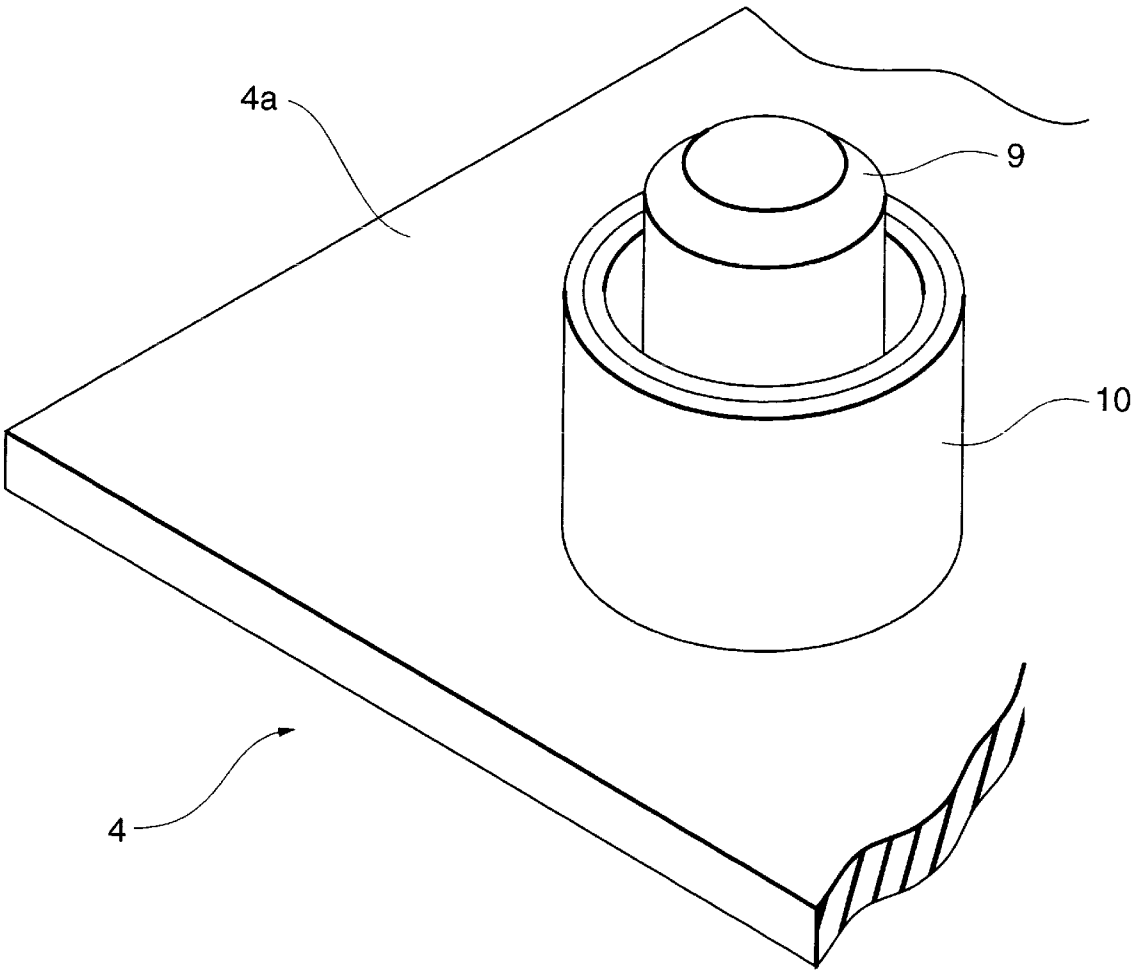
FIG. 2 is an illustration showing a key seat in the water proof and dust proof structure of the key switch device according to the first embodiment of the present invention.
Figure 3:
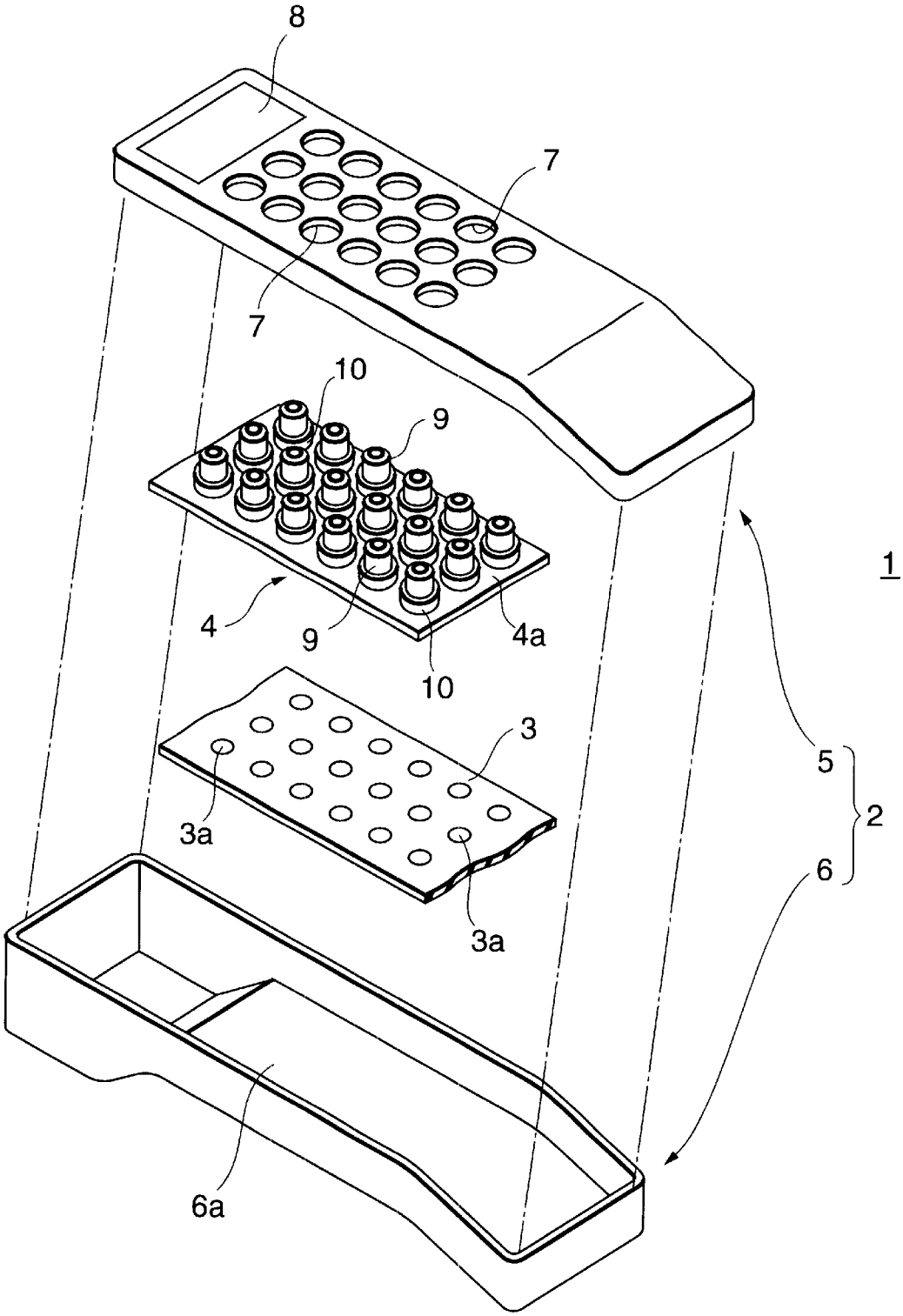
FIG. 3 is an exploded illustration showing an example of use of the water proof and dust proof structure of the key switch device according to the first embodiment of the present invention.
Figure 4:
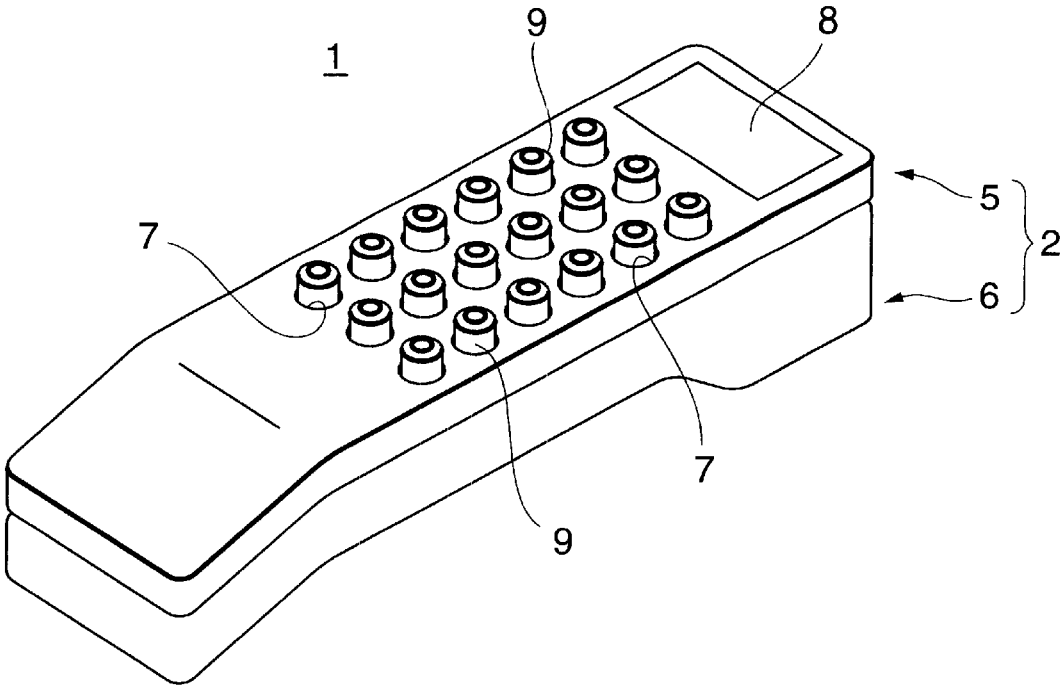
FIG. 4 is an assembled illustration showing an example of use of the water proof and dust proof structure of the key switch device according to the first embodiment of the present invention.

FIG. 1 is a cross sectional view showing a water proof and dust proof structure of a key switch device according to a first embodiment of the present invention, and similarly, FIG. 2 is an illustration showing a key seat in the water proof and dust proof structure of the key switch device according to the first embodiment of the present invention, and FIG. 3 and FIG. 4 are an exploded illustration and an assembled illustration showing an example of use of the water proof and dust proof structure of a key switch device according to the first embodiment of the present invention.

In FIGS. 1 to 4, the water proof and dust proof structure of a key switch device denoted by reference numeral 1 has an instrument case 2, a key base 3, and a key seat 4, and it is used, for example, for a portable wireless phone or cellular phone.

Figure 6:
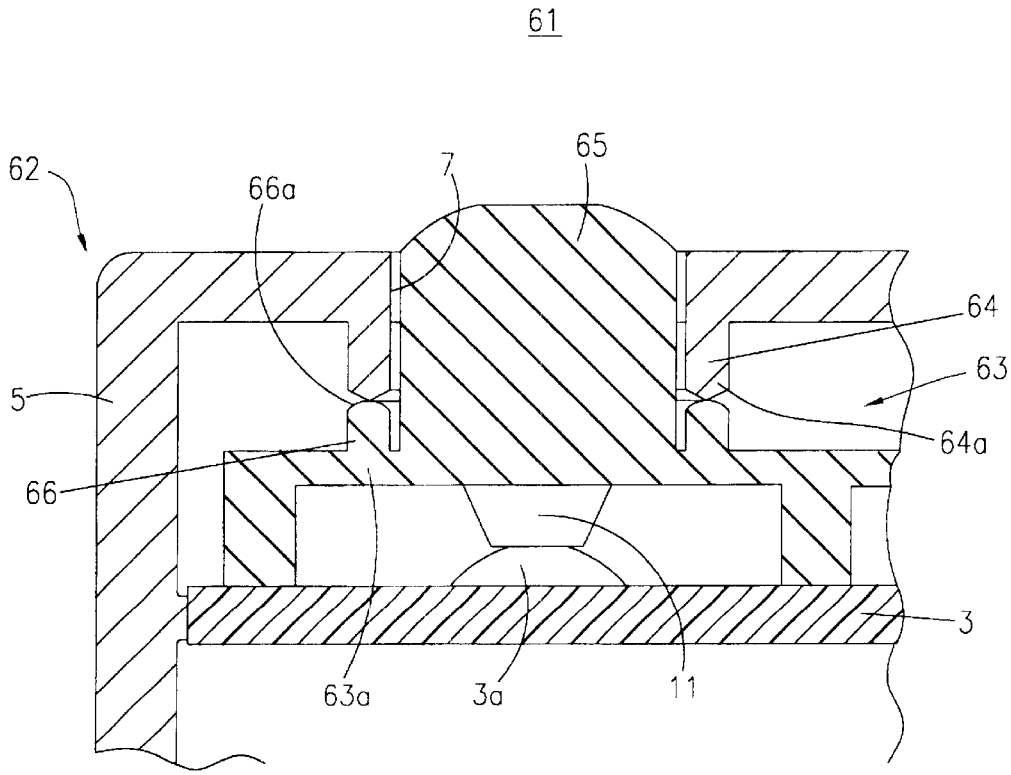
FIG. 6 is a cross sectional view showing the water proof and dust proof structure of the key switch device according to a third embodiment of the present invention.

The instrument case 2 is a housing or case of the wireless phone or the cellular phone. The instrument case 2 has a front case 5 and a rear cover 6 (FIG. 6).

The front case 5 is formed by a flat and approximately rectangular box body in which the total body is open in one direction. In the front panel of the front case 5, a lot of key insertion holes 7 arranged in parallel longitudinally and laterally in the flat surface and a display window 8 which makes it possible to see the interior of the case from the outside of the case are provided. At both end portions in the longitudinal direction of the front panel in the front case 5, a mouth piece and an ear piece (both not shown in the figure) open to the inside and outside of the case are provided, respectively.

The rear cover 6 is mounted to the front case 5 in the state where the opening end surface of the cover is brought into contact with the opening end surface of the case, and it is formed by a flat and approximately rectangular box body in which the total body is open in one direction. At the rear plate of the rear cover 6, a step portion 6*a* where the key base 3 is mounted is provided.

The key base 3 is made of a print circuit board having a lot of diaphragms 3*a* arranged in parallel longitudinally and laterally in the flat surface and switch contact point portions (not shown in the figure) contained in these respective diaphragms 3*a*, and it is contained in the instrument case 2, and is fixed on the step portion 6*a* of the rear cover 6. On the key base 3, a transmitting portion and a receiving portion (both not shown in the figure) positioned near the mouth piece and ear piece respectively and a display portion (not shown in the figure) positioned opposite to the display window 8 are packaged.

The key seat 4 is made of a flexible member such as a silicon rubber having a seat main body 4*a*, and it is packaged on the key base 3, and is contained in the instrument case 2. On the seat surface of the key seat 4, approximately columnar keys 9 inserted into the respective key insertion holes 7 and circular ribs 10 surrounding the side portions of these keys 9 are integrally provided.

The thickness of the end portion on the key base side of the rib 10 is set at a size a little larger than the thickness of the seat main body 4*a*, and the thickness of the end portion (tip portion) on the instrument case side is set at a size which becomes smaller toward the rib pressed contact side from the switch contact point portion side by applying a chamfering spanning to the rib peripheral surface from the rib opening end surface. Consequently, when the key 9 is pressed in the state where the case is assembled, the seat main body 4*a* is bent so that the switch thrust piece 11 may thrust the diaphragm 3*a*, and the switch contact point portion on the key base 3 becomes conductive. Furthermore, when assembling the case, the rib 10 is bent inside to be pressed and brought into contact with the opening periphery of the key insertion hole 7, and the sealing is performed between the tip surface (opening end surface) of the rib 10 and the opening periphery of the key insertion hole 7.

On the other hand, on the reverse side of the key seat 4, a switch thrust piece 11 corresponding to the switch contact point portion of the key base 3 and a seat leg portion 12 surrounding each of these switch thrust piece 11 and diaphragm 3*a* are integrally provided.

In such a water proof and dust proof structure of a key switch device, the opening end surface of the rib 10 is pressed and brought into contact with the opening periphery of the key insertion hole 7, so that the sealing may be performed between the opening end surface of the rib 10 and the opening periphery of the key insertion hole 7.

Accordingly, in the present embodiment, there is no seal member and no spacer between the instrument case 2 and the key seat 4, which is different from the prior art, and therefore, the number of pieces of parts can be reduced.

Furthermore, in the present embodiment, the opening end surface of the rib 10 is pressed and brought into contact with the opening periphery of the key insertion hole 7, so that a pressing contact force can sufficiently be obtained by the rib 10, and in the meantime, the sealing position becomes higher than the conventional sealing position, so that the sealing power between the opening periphery of the key insertion hole 7 and the opening end surface of the rib 10 and the reliability in sealing can sufficiently be assured, and rain water or the like can surely be prevented from reaching electronic parts such as a key base 3.

Next, a second embodiment of the present invention will be described by using FIG. 5.

Figure 5:
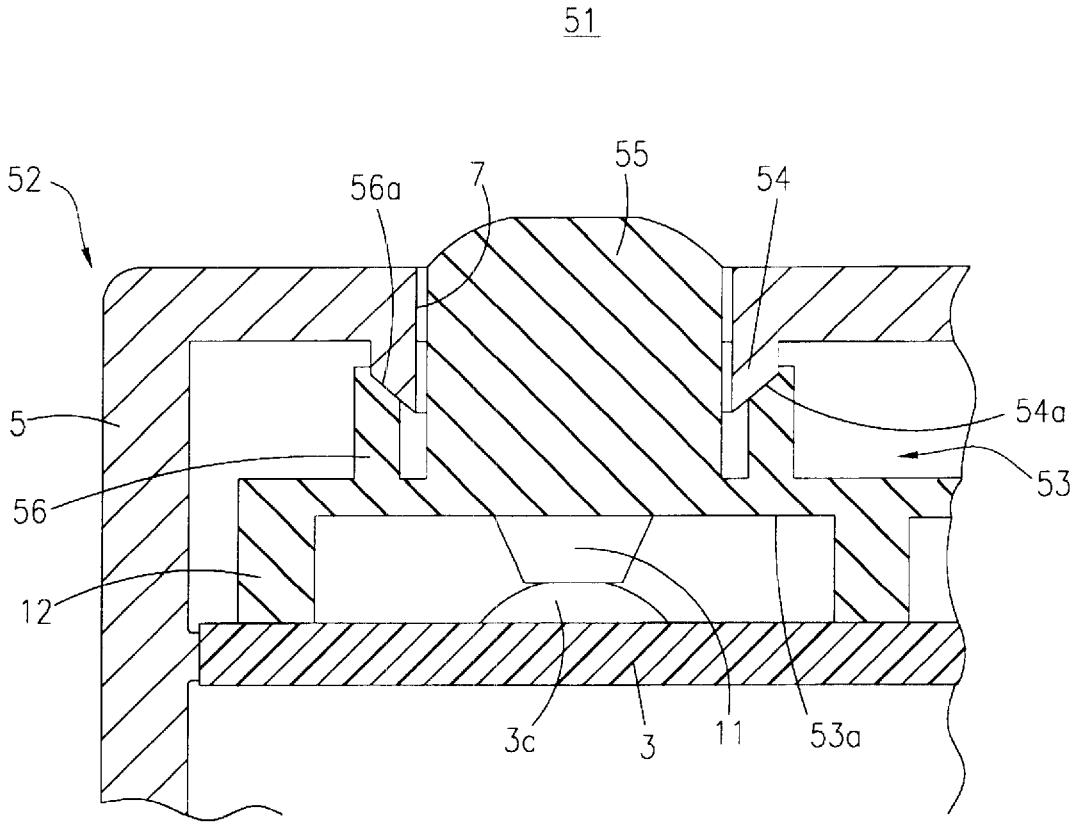
FIG. 5 is a cross sectional view showing the water proof and dust proof structure of the key switch device according to a second embodiment of the present invention.

FIG. 5 is a cross sectional view showing a water proof and dust proof structure of a key switch device according to the second embodiment of the present invention, and in the above described figure, the same reference numerals are given to the same members as those in FIG. 1, and the detailed description will be omitted.

In the above described figure, the water proof and dust proof structure of a key switch device denoted by reference numeral 51 has an instrument case 52, a key base 3, and a key seat 53.

The instrument case 52 has a front case 5 and a rear cover 6. At the inside opening periphery of the key insertion hole 7 in the front case 5, a circular rising wall 54 (Frame-like rising wall) surrounding the peripheral surface of the above described key 9 is integrally provided. To the rising wall 54, a slant surface 54*a* as the seal portion is formed by applying a chamfering spanning to the peripheral surface from the opening end surface.

The key seat 53 is made of a flexible member such as a silicon rubber having a seat main body 53*a*, and it is packaged on the key base 3, and is contained in the instrument case 52. On the seat surface of the key seat 53, approximately columnar keys 55 inserted into the respective key insertion holes 7 and circular ribs 56 surrounding the side portions of these keys 55 are integrally provided.

In the rib 56, a slant surface 56*a* as the sealing portion is formed, which can be pressed and brought into contact with the slant surface 54*a* of the rising wall 54 by providing a notch spanning to the inside peripheral surface from the opening end surface. Consequently, in the state where the case is assembled, the slant surface 56*a* of the rib 56 is pressed and brought into contact with the slant surface 54*a* of the rising wall 54.

Accordingly, in the present embodiment, the sealing is performed between the slant surface 54*a* of the rising wall 54 and the slant surface 56*a* of the rib 56. In this case, the degree of close contact between both slant surfaces 54*a*, 56*a* is raised by the wedge effect.

Furthermore, in the present embodiment, similarly to the first embodiment, the number of pieces of parts can be reduced, and in the meantime, rain water or the like can surely be prevented from reaching electronic parts such as a key base 3.

Next, a third embodiment of the present invention will be described by using FIG. 6.

FIG. 6 is a cross sectional view showing a water proof and dust proof structure of a key switch device according to the third embodiment of the present invention, and in the above described figure, the same reference numeral is given to the same member as that in FIG. 1, and the detailed description will be omitted.

In the above described figure, the water proof and dust proof structure of a key switch device denoted by reference numeral 61 has an instrument case 62, a key base 3, and a key seat 63.

The instrument case 62 has a front case 5 and a rear cover 6. At the inside opening periphery of the key insertion hole 7 in the front case 5, a circular rising wall 64 surrounding the peripheral surface of the above described key 9 is integrally provided. At the tip surface of the rising wall 64, a projection 64*a* is formed, which has an approximately isosceles triangle-like cross section in which the wall thickness becomes smaller toward the key seat side from the instrument case side.

The key seat 63 is made of a flexible member such as a silicon rubber having a seat main body 63*a*, and it is packaged on the key base 3, and is contained in the instrument case 62. On the seat surface of the key seat 63, approximately columnar keys 65 inserted into the respective key insertion holes 7 and circular ribs 66 surrounding the side portions of these keys 65 are integrally provided.

At the tip surface of the rib 66, a projection 66*a* is formed, which has an approximately half-circular cross section and can be pressed and brought into contact with the projection 64*a* of the rising wall 64. Consequently, in the state where the case is assembled, the projection 66*a* of the rib 66 is pressed and brought into contact with the projection 64*a* of the rising wall 64, so that the sealing may be performed between both these projections 64*a*, 66*a*.

Accordingly, in the present embodiment, in order to perform the sealing between both projections 64*a*, 66*a*, the shapes of the cross sections of both projections 64*a*, 66*a* are made like an isosceles triangle and a half-circle, respectively, so that the dimensional error between the instrument case 62 and the key seat 63 can be absorbed. That is, the tip portion or the opening inside or outside peripheral surface in the projection 64*a* of the rising wall 64 is pressed and brought into contact with the tip surface in the projection 66*a* of the rib 66 according to the size of the dimensional error between both members 62, 63.

Furthermore, in the present embodiment, similarly to the first embodiment and the second embodiment, the number of pieces of parts can be reduced and in the meantime, rain water or the like can surely be prevented from reaching electronic parts such as a key base 3.

Next, a fourth embodiment of the present invention will be described by using FIG. 7.

Figure 7:
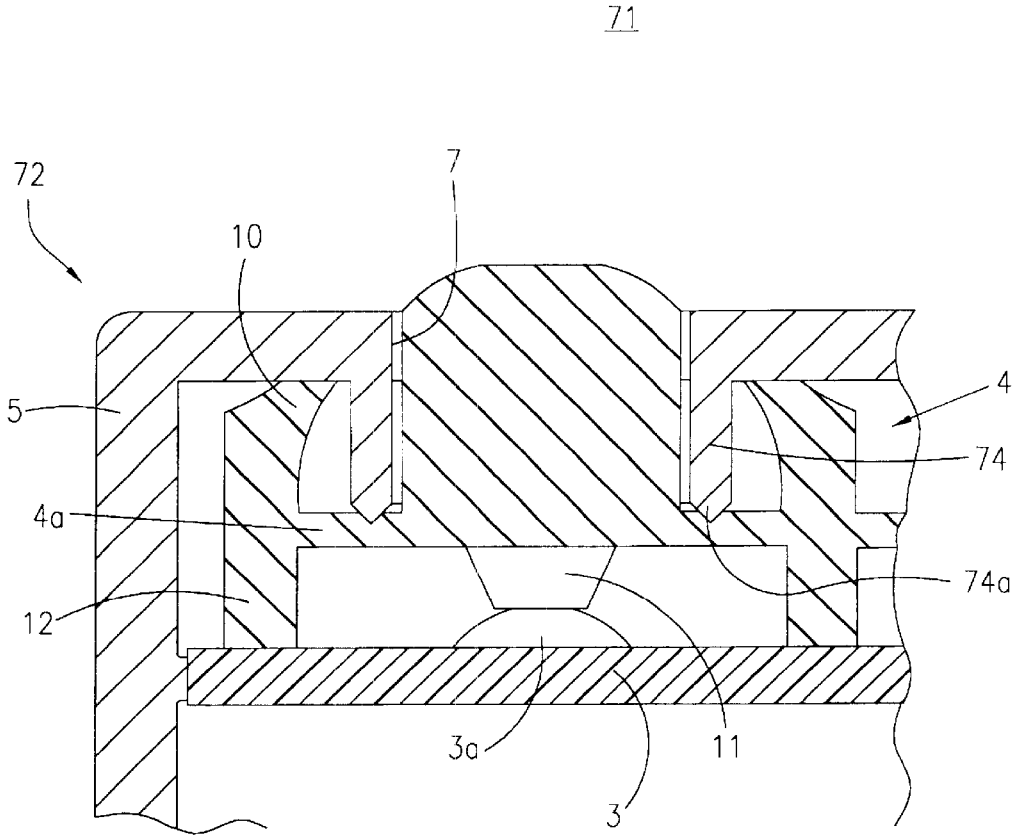
FIG. 7 is a cross sectional view showing the water proof and dust proof structure of the key switch device according to a fourth embodiment of the present invention.

FIG. 7 is a cross sectional view showing a water proof and dust proof structure of a key switch device according to the fourth embodiment of the present invention, and in the above described figure, the same reference numeral is given to the same member as that in FIG. 1, and the detailed description will be omitted.

In the above described figure, the water proof and dust proof structure of a key switch device denoted by reference numeral 71 has an instrument case 72, a key base 3, and a key seat 4.

The instrument case 72 has a front case 5 and a rear cover 6. At the inside opening periphery of the key insertion hole 7 in the front case 5, a circular rising wall 74 positioned inside the rib 10 and surrounding the peripheral surface of the above described key 9 is integrally provided. At the tip surface of the rising wall 74, a projection 74*a* is formed, which has an approximately isosceles triangle-like cross section in which the wall thickness becomes smaller toward the key seat side from the instrument case side. Consequently, the projection 74*a* of the rising wall 74 is pressed and brought into contact with the seat surface in the state where the tip portion bites into the seat main body 4*a* of the key seat 4, so that the sealing may be performed between the projection 74*a* and the seat main body 4*a*.

Accordingly, in the present embodiment, the tip portion of the rib 10 is pressed and brought into contact with the opening periphery of the key insertion hole 7 and in the meantime, the tip portion (projection 74*a*) of the rising wall 74 is pressed and brought into contact with the seat main body 4*a* of the key seat 4, and therefore, the sealing is performed at two parts between the opening end surface of the rib 10 and the opening periphery of the key insertion hole 7 and between the opening end surface of the projection 74*a* and the seat surface of the seat main body 4*a*, so that the water proof and dust proof effect can still more raised.

Furthermore, in the present embodiment, the number of pieces of parts can be reduced and in the meantime, rain water or the like can sure be prevented from reaching electronic parts such as a key base 3, which is similar to the first to third embodiments.

Furthermore, in each embodiment, the case of being applied to a portable telephone radio set has been described, but the present invention is not limited to this, and for example, it can also be applied to other electronic instruments such as a portable personal computer, similarly to each embodiment.

As mentioned above, according to the present invention, a frame-like rib which is pressed and brought into contact with the inside opening periphery of the key insertion hole and surrounds the side portion of the key is integrally provided to the key seat, and therefore, the sealing is performed between the opening end surface of the rib in the key seat and the inside opening periphery of the key insertion hole in the instrument case.

Accordingly, there is no seal member and no spacer between the instrument case and the key seat, which is different from the prior art, and therefore the number of pieces of parts can be reduced, and simplification of the device assembly work and lowering of the cost can be attained.

Furthermore, since the opening end surface of the rib is pressed and brought into contact with the inside opening periphery of the key insertion hole, the sealing power between the inside opening periphery of the key insertion hole and the opening end surface of the rib and the reliability in sealing can sufficiently be assured, and therefore, rain water or the like can surely be prevented from reaching electronic parts such as a key base, so that the water proof and dust proof effect can be raised.

What is claimed is:

1. A water proof and dust proof structure of a key-switch device, comprising:

an instrument case having a key-insertion hole extending between inside and outside surfaces of the case, the instrument case having an integral annular cylinder extending from the inside surface of the instrument case so as to surround the key-insertion hole;

a key base contained in the instrument case and having a switch contact portion;

a key seat provided on the key base and made of a flexible member, the key seat having a key provided thereon so as to be inserted into the key-insertion hole and a switch thrust piece corresponding to the switch contact portion, the key having an integral annular rib extending from a surface of the key seat so as to surround the key and being adapted to be brought into contact with and pressed against the cylinder; and seal portions provided at respective tip portions of the rib and the cylinder and adapted to be pressed into contact with each other.

2. The water roof and dust proof structure of a key-switch device according to claim 1, wherein the seal portion of the rib and the seal portion of the cylinder are formed by a slant surface.

3. The water proof and dust proof structure of a key switch device according to claim 1, wherein one seal portion among the seal portion of the rib and the seal portion of the cylinder is formed by a projection having an approximately half-circular cross section, and the other seal portion is formed by a projection having an approximately triangular cross section.

4. A protective arrangement for a push-button device, the arrangement comprising:

a case defining a plurality of key openings, each of the plurality of key openings having a periphery from which an annular wall extends;

a deformable member within the case and having a first surface and a second surface;

a plurality of keys arranged on the first surface of the deformable member so as to extend through a respective one of the plurality of key openings; and a plurality of annular ribs extending from the first surface of the deformable member and surrounding a respective one of the plurality of keys, each of the plurality of annular ribs contacting a respective one of the annular walls to form a seal around one of the plurality of keys, wherein upon pressing a key of the plurality of keys, the deformable member is deformed and the annular wall and annular rib surrounding the pressed key remain in contact with each other so as to maintain the seal around the pressed key.

5. The protective arrangement according to claim 4, further comprising:

a plurality of switch thrust members provided on the second side of the deformable member, each of the plurality of switch thrust members being aligned with a respective one of the plurality of keys;

a printed circuit board within the case; and a plurality of switch contacts arranged on the printed circuit board so as to align with a respective one of the plurality of switch thrust members.

6. The protective arrangement according to claim 5, further comprising:

a plurality of annular leg portions extending from the second side of the deformable member and contacting the printed circuit board, each of the plurality of annular leg portions surrounding a respective one of the plurality of switch thrust members.

7. The protective arrangement according to claim 4, wherein the plurality of annular walls each define an end surface and the plurality of annular ribs each define an end surface, wherein the end surface of each of the plurality of annular ribs contacts the end surface of the respective one of the annular walls to form the seal.

8. The protective arrangement according to claim 7, wherein the end surface of the annular walls and the end surface of the annular ribs are slanted.

9. The protective arrangement according to claim 7, wherein the end surface of the annular walls has a triangular cross-section.

10. The protective arrangement according to claim 9, wherein the end surface of the annular ribs has a half-circular cross-section.

* * * * *